US007691005B2

(12) United States Patent
Mitsuba

(10) Patent No.: US 7,691,005 B2
(45) Date of Patent: Apr. 6, 2010

(54) GOLF BALL

(75) Inventor: Atsuko Mitsuba, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/802,875

(22) Filed: May 25, 2007

(65) Prior Publication Data

US 2008/0020865 A1 Jan. 24, 2008

(30) Foreign Application Priority Data

Jul. 19, 2006 (JP) ..... 2006-196454

(51) Int. Cl.
*A63B 69/36* (2006.01)

(52) U.S. Cl. ..... 473/280; 473/351; D21/708

(58) Field of Classification Search ..... 473/280, 473/281, 378, 406, 351; D21/708–709
See application file for complete search history.

(56) References Cited

U.S. PATENT DOCUMENTS

| | | | | | |
|---|---|---|---|---|---|
| 676,506 | A * | 6/1901 | Knight et al. | ..... | 473/268 |
| 3,753,565 | A * | 8/1973 | Baker | ..... | 473/266 |
| 5,067,719 | A * | 11/1991 | Mook | ..... | 473/200 |
| 5,662,530 | A * | 9/1997 | Sellar | ..... | 473/268 |
| 5,713,799 | A * | 2/1998 | Balmat | ..... | 473/200 |
| D393,672 | S * | 4/1998 | Clay | ..... | D21/713 |
| D411,598 | S * | 6/1999 | Disco | ..... | D21/708 |
| 6,742,449 | B2 * | 6/2004 | Sosin | ..... | 101/35 |
| 6,852,039 | B2 * | 2/2005 | Pettigrew et al. | ..... | 473/280 |
| D503,759 | S * | 4/2005 | Van Bellinger | ..... | D21/708 |
| D523,100 | S * | 6/2006 | Sano | ..... | D21/708 |
| D524,884 | S * | 7/2006 | Sano | ..... | D21/708 |
| D525,669 | S * | 7/2006 | Chute | ..... | D21/708 |
| 2002/0086741 | A1 * | 7/2002 | Newcomb | ..... | 473/351 |

FOREIGN PATENT DOCUMENTS

| | | |
|---|---|---|
| JP | 55-158758 | 5/1954 |
| JP | 50-107266 U | 9/1975 |
| JP | 59-30261 A | 2/1984 |
| JP | 3057733 U | 3/1999 |
| JP | 3092208 U | 12/2002 |
| JP | 3105661 U | 9/2004 |
| JP | 2005-253546 A | 9/2005 |

* cited by examiner

*Primary Examiner*—Nini Legesse
(74) *Attorney, Agent, or Firm*—Birch, Stewart, Kolasch & Birch, LLP

(57) ABSTRACT

Golf ball 2 of the present invention has a group 4 of multiple marks which are visible at one view. This group 4 of marks includes a target mark t consisting of single or multiple marks provided along one great circle, and an inclined mark k which appears to be inclined with respect to this target mark t. The inclined mark k may be provided as a linear mark which appears to be inclined with respect to the target mark t. The group of marks may include a target mark t consisting of single or multiple marks provided along one great circle, and a side mark s provided on the side of this target mark t. This side mark s preferably has a dot shape. The group of marks may include a target mark t consisting of single or multiple marks provided along one great circle, and an accompanied mark h provided on the same great circle on which the target mark t is provided.

1 Claim, 13 Drawing Sheets

GOLF BALL

This application claims priority on Patent Application No. 2006-196454 filed in JAPAN on Jul. 19, 2006. The entire contents of this Japanese Patent Application are hereby incorporated by reference.

BACKGROUND OF THE INVENTION

1. Field of the Invention

The present invention relates to golf balls having a mark thereon.

2. Description of the Related Art

In general, golf balls have a mark thereon. Typical examples of this mark are letters indicating the trade name, manufacturer name and the like.

In addition to the mark shown by letters, balls having a straight mark have been known. This straight mark is a linear mark provided along a great circle of the ball. According to visual observation, this linear mark seems to run almost straight. This straight mark is utilized in tee shots and putting. Upon preparing for tee shots, the player can place the ball him/herself. Upon preparing for putting, the player can pick up the ball once, and then can place it again. Upon preparing for tee shots and putting, the ball can be placed so that the straight mark suggests the intended direction. Precise address toward the target is enabled by placing the ball so that the straight mark suggests the intended direction, and addressing based on this straight mark.

SUMMARY OF THE INVENTION

The present invention relates to marks defined based on a technical idea that is completely different from those in the prior arts as described above. The mark according to the present invention exhibits a distinctive effect that could not be achieved by the aforementioned prior arts at all. The mark in the foregoing prior art can merely suggest the intended direction. In contrast, the mark according to the present invention can control orbit of the head, ballistic trajectory or impact point.

An object of the present invention is to provide a golf ball having marks which can control the orbit of the head, ballistic trajectory or impact point.

The golf ball according to one aspect of the present invention has a group of multiple marks which are visible at one view. This group of marks includes a target mark consisting of single or multiple marks provided along one great circle. This group of marks includes an inclined mark which appears to be inclined with respect to this target mark.

Preferably, the inclined mark is a linear mark which appears to be inclined with respect to the target mark.

The golf ball according to another aspect of the present invention has a group of multiple marks which are visible at one view. The group of marks includes a target mark consisting of single or multiple marks provided along one great circle. The group of marks includes a side mark provided on the side of this target mark. Preferably, this side mark has a dot shape.

The golf ball according to still another aspect of the present invention has a group of multiple marks which are visible at one view. The group of marks includes a target mark consisting of single or multiple marks provided along one great circle. The group of marks includes an accompanied mark provided on the same great circle on which the target mark is provided.

The orbit of the head, ballistic trajectory or impact point can be controlled by a swing with the address to orientate the target mark while looking at the inclined mark, the side mark or the accompanied mark.

DESCRIPTION OF THE PREFERRED EMBODIMENTS

Hereinafter, the present invention will be described in detail according to the preferred embodiments with appropriate references to the accompanying drawing.

Figure 1A:
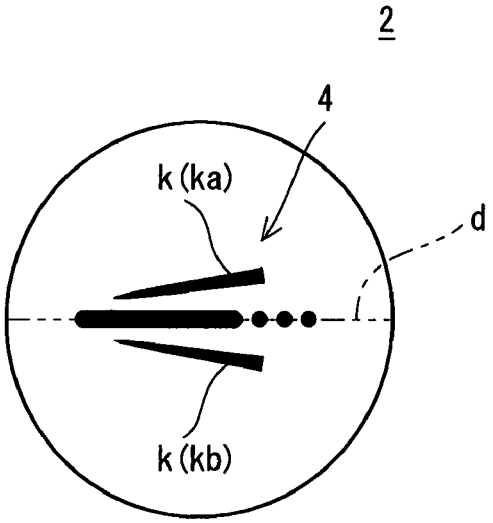
FIG. 1A shows a view illustrating a golf ball according to one embodiment of the present invention.
Figure 1B:
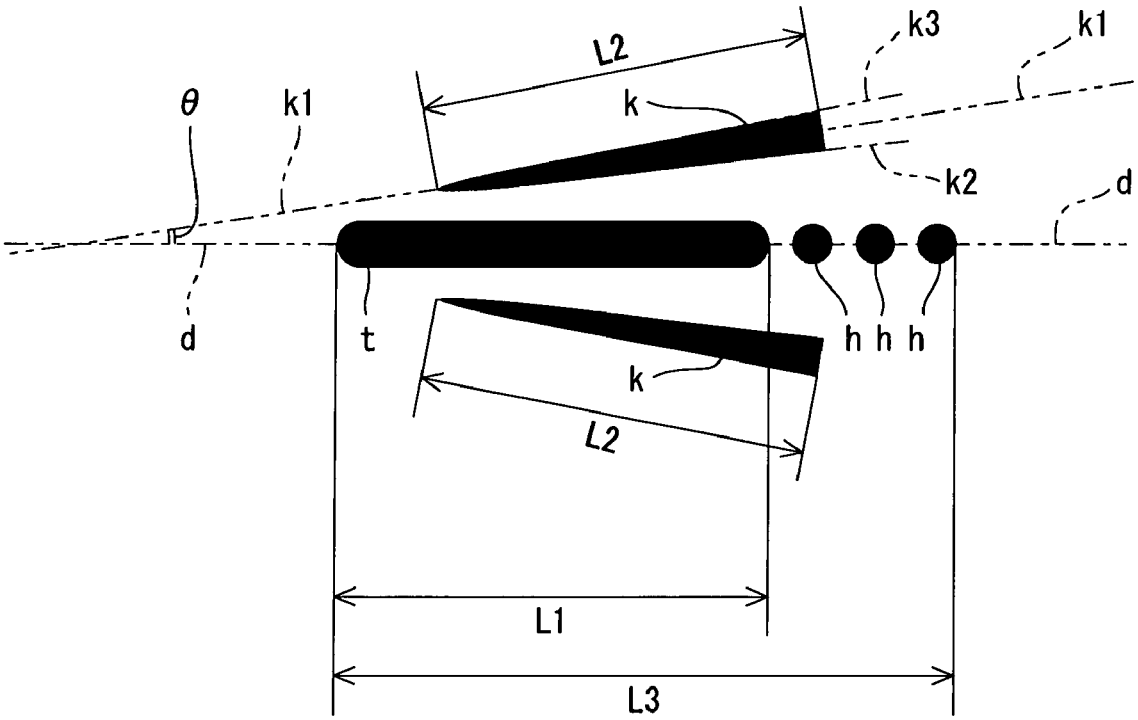
FIG. 1B shows an enlarged view illustrating a mark area in the golf ball shown in FIG. 1A.

Golf ball 2 shown in FIG. 1A and FIG. 1B has a group 4 of marks. The group 4 of marks is printed on the surface of the ball. The group 4 of marks is provided on one site on the golf ball 2. Although not shown in the figures, the group 4 of marks is printed on a paint layer of the ball. The group 4 of marks may be covered by a clear paint layer. The group 4 of marks should be visually observed. Printing of the group 4 of marks may be carried out by a known procedure such as pad printing or thermal transfer.

Although not shown in the figures, the golf ball 2 has numerous dimples. Constitution of the dimples is similar to those of conventionally known golf balls. In Figures attached hereto, illustration of the dimples is omitted.

FIG. 1B shows an enlarged view of the group 4 of marks. The group 4 of marks includes multiple marks. The group 4 of marks includes a target mark t, inclined marks k, and accompanied marks h. The target mark t, the inclined marks k, and the accompanied marks h are visible at one view. The target mark t, the inclined marks k, and the accompanied marks h are provided in an area which can be seen at once from one point of view. Upon the address, the golf player can see the target mark t, the inclined marks k, and the accompanied marks h at one view.

Because the golf ball 2 has a spherical shape, it has a great circle. The great circle refers to a circle on the surface of the sphere yielded by allowing a plane that passes to cross the center of the sphere. In the present invention, the great circle refers to a circle on the surface of the golf ball yielded by allowing a plane that passes to cross the center of the golf ball. In one golf ball, the great circles are present in uncountable numbers.

The target mark t may be single or multiple marks provided along one great circle d. In the embodiment shown in FIG. 1A, the target mark t has a linear shape. The target mark t is present on great circle d. The target mark may be an aggregate of dot marks. The multiple dot marks constituting the target mark t are aligned on a substantially straight line along one great circle d. The linear target mark t appears to be a substantially straight line. A substantially straight target line is imaged by the target mark t. The ball may be placed with the target line to direct toward the intended direction, and then addressing can be executed based on this target line. Upon the address, orientation of the face can be adjusted based on the target line.

The inclined mark k is a mark which appears to be inclined with respect to the target mark. The group 4 of marks includes two inclined marks k. The inclined marks k are provided on the left and right sides of the target mark t. Only one inclined mark k may be provided on either one side or another side of the target mark t. The inclined mark k may be an aggregate of dot marks (separate dot marks). The dot marks constituting the inclined mark k are aligned on a substantially straight line along a line inclined with respect to the great circle of the target mark.

The accompanied mark h is a mark provided on the same great circle d on which the target mark t is provided. In the group 4 of marks, three accompanied marks h are provided. In the group 4 of marks, the accompanied marks h are provided on one side of an extended line along the great circle d (FIG. 1B, right side). The accompanied mark may be also provided on one side and another side of an extended line along the great circle d. The accompanied marks h have a dot shape. The accompanied mark h has a circular shape. By thus making the accompanied marks h to have a dot shape, effect achieved by the accompanied mark h described later is improved.

FIG. 2A to FIG. 2H, and FIG. 3A to FIG. 3H show other embodiments of the golf ball according to the present invention. All of the marks shown in FIG. 3A to FIG. 3H include the target mark t and the inclined marks k. In all embodiments illustrated in FIG. 2A to FIG. 2H and FIG. 3A to FIG. 3H, the inclined marks k are provided on both sides of the target mark t. In all embodiments illustrated in FIG. 2A to FIG. 2H and FIG. 3A to FIG. 3H, the inclined marks k are symmetric with respect to the target mark t. In all embodiments illustrated in FIG. 2A to FIG. 2H and FIG. 3A to FIG. 3H, the target mark t is situated on one great circle (the great circle not shown in the figures).

Figure 2A:
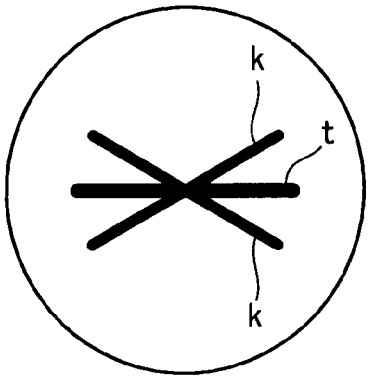
FIG. 2A, FIG. 2B, FIG. 2C, FIG. 2D, FIG. 2E, FIG. 2F, FIG. 2G and FIG. 2H show a view illustrating a golf ball according to other embodiment of the present invention.
Figure 2B:
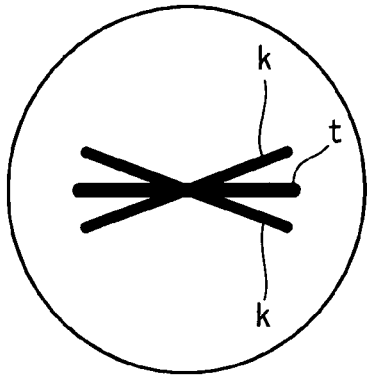
Figure 2C:
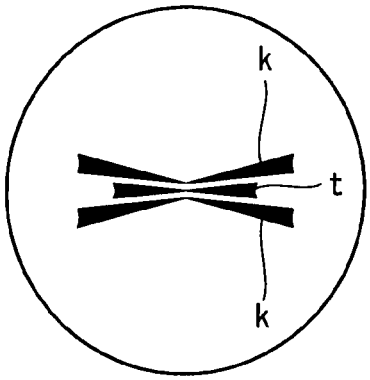
Figure 2D:
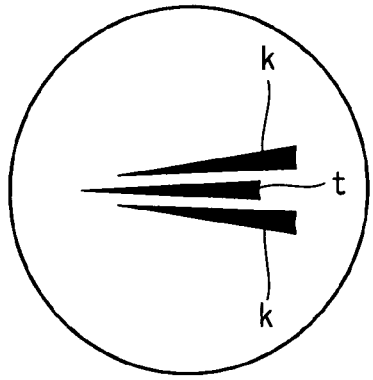
Figure 2E:
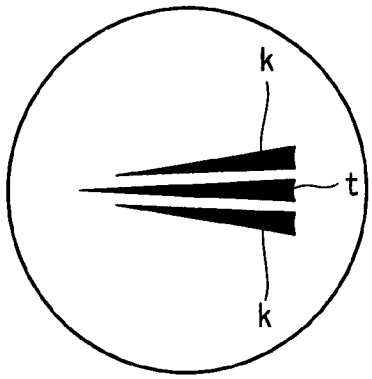
Figure 2F:
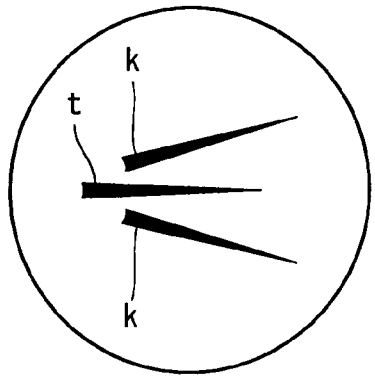

The target mark t and the inclined marks k may be separated each other, or a part of them may be overlapped. The embodiments in which the target mark t and the inclined marks k are separated are shown in FIG. 2C to FIG. 2H. The embodiments in which the target mark t crosses the inclined marks k are shown in FIG. 2A and FIG. 2B. The embodiments in which the target mark t and the inclined marks k are overlapped at each part thereof are shown in FIG. 3C, FIG. 3E, FIG. 3F, FIG. 3G and FIG. 3H. In FIG. 3B, FIG. 3C, FIG. 3E, FIG. 3F, FIG. 3G and FIG. 3H, a mark looking like an arrowhead is formed with the target mark t and two inclined marks k. This mark looking like an arrowhead serves in facilitating the directing of the target mark t toward the intended direction.

In the present invention, the shapes of the target mark t, the inclined marks k and the accompanied mark h are not limited. For example, the embodiment shown in FIG. 2A demonstrates a straight target mark t having a uniform width and rounded both ends. For example, the embodiment shown in FIG. 2A demonstrates straight inclined marks k having a uniform width and rounded both ends. For example, the embodiments shown in FIG. 2D, FIG. 2E and FIG. 2F demonstrate a target mark t having the width increasing from one end toward another end, and having a pointed shape at the one end. The embodiments shown in FIG. 2D, FIG. 2E and FIG. 2F demonstrate inclined marks k having the width increasing from one end toward another end, and having a pointed shape at the one end. For example, in the embodiment shown in FIG. 2E, the inclined marks k and the target mark t are oriented such that the pointed end sides correspond to one side, while unpointed end sides correspond to another side.

Figure 2G:
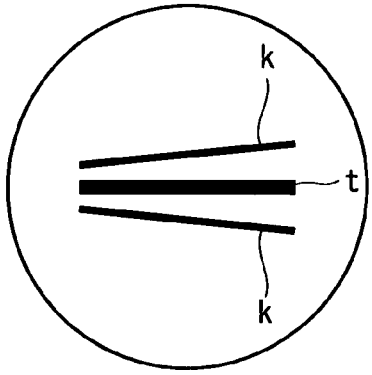
Figure 2H:
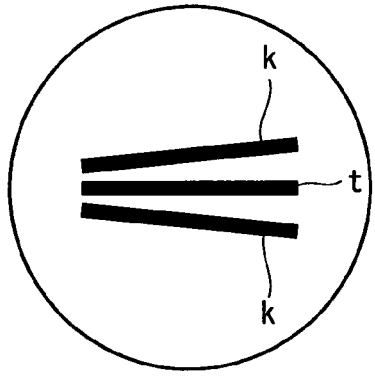
Figure 3A:
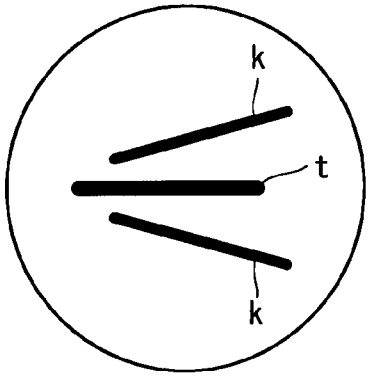
FIG. 3A, FIG. 3B, FIG. 3C, FIG. 3D, FIG. 3E, FIG. 3F, FIG. 3G and FIG. 3H show a view illustrating a golf ball according to other embodiment of the present invention.
Figure 3B:
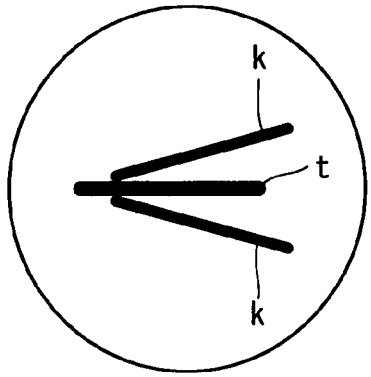
Figure 3C:
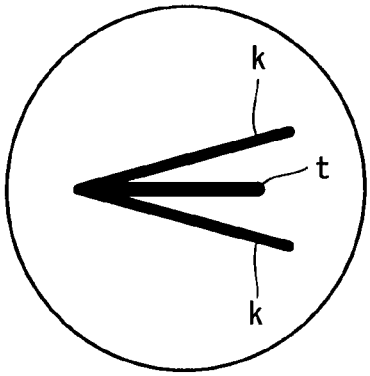
Figure 3D:
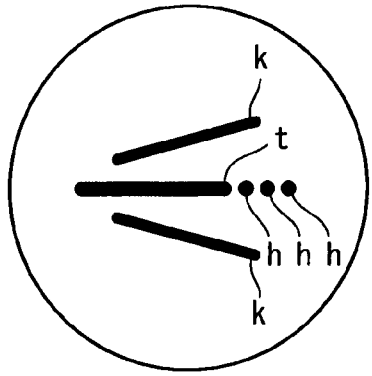
Figure 3E:
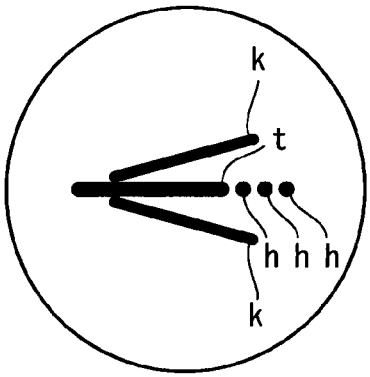
Figure 3F:
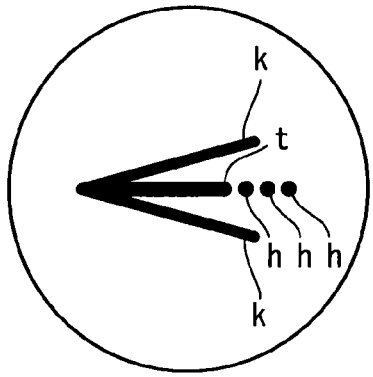
Figure 3G:
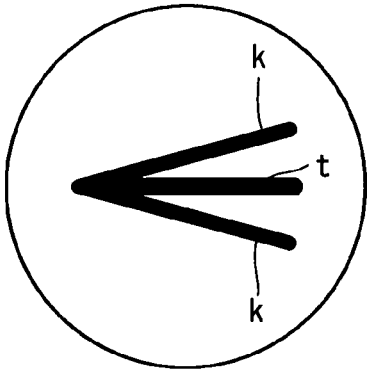
Figure 3H:
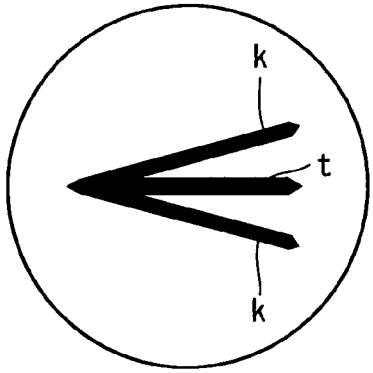

The embodiments shown in FIG. 2G and FIG. 2H demonstrate a straight target mark t having a uniform width and squarish both ends. The embodiments shown in FIG. 2G and FIG. 2H demonstrate straight inclined marks k having a uniform width and squarish both ends. In the embodiment shown in FIG. 2G, the width of the target mark t is greater than the width of the inclined marks k. In the embodiment shown in FIG. 2H, the width of the inclined marks k is equal to the width of the target mark t.

In the case of the inclined mark k being a linear mark, the following three instances (1) to (3) will be exemplified in which the inclined mark k appears to be inclined with respect to the target mark t.

(1) Mid line k1 in the width direction of the inclined mark k appears to be inclined with respect to the great circle d of the target mark t.

(2) Inside edge k2 of the inclined mark k appears to be inclined with respect to the great circle d of the target mark t.

(3) External side edge k3 of the inclined mark k appears to be inclined with respect to the great circle d of the target mark t.

Moreover, marks of a broken line obtained by erasing the inclined marks k as in (1) to (3) described above with a given interval may be involved in the inclined marks k.

Figure 4A:
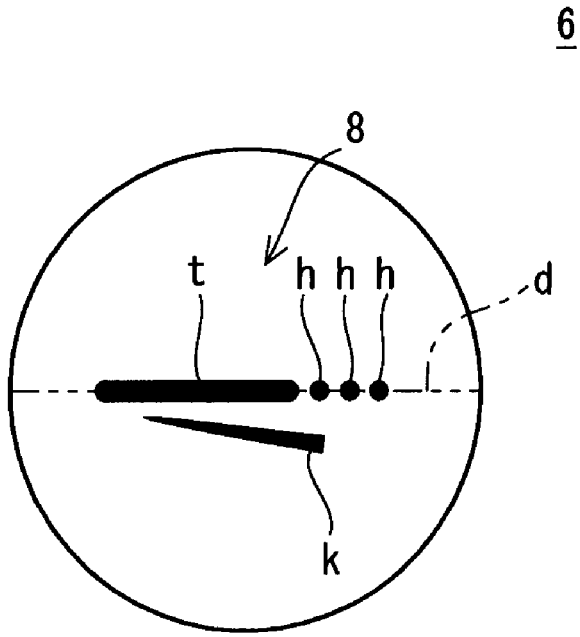
FIG. 4A shows a view illustrating a golf ball according to other embodiment of the present invention.
Figure 4B:
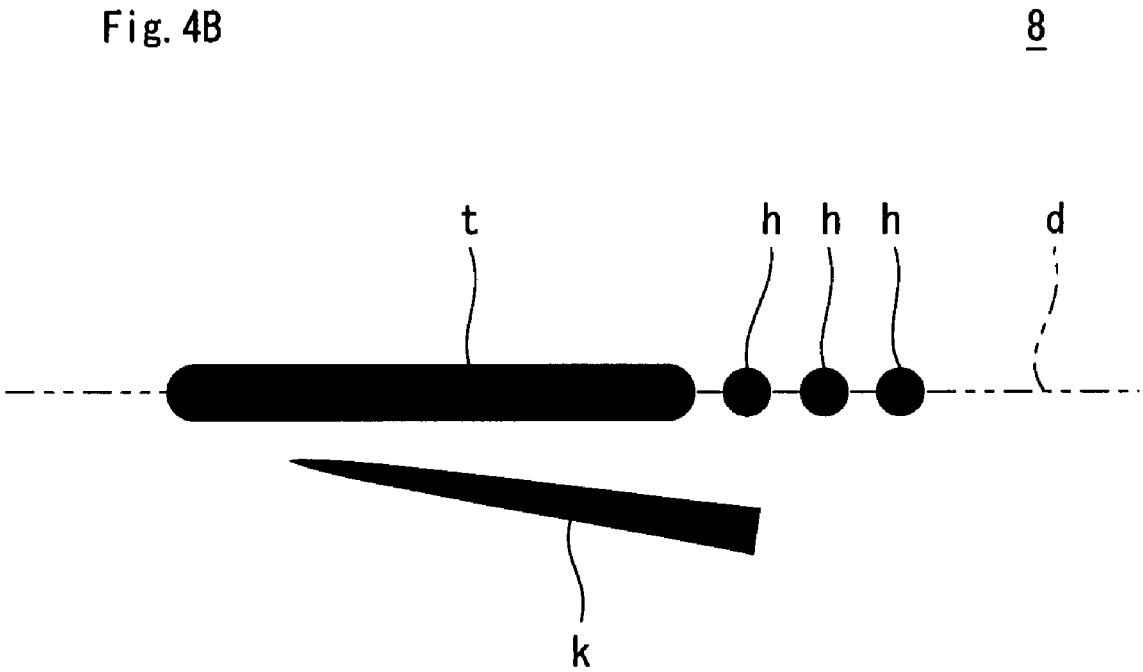
FIG. 4B shows an enlarged view illustrating a mark area in the golf ball shown in FIG. 4A.
Figure 5A:
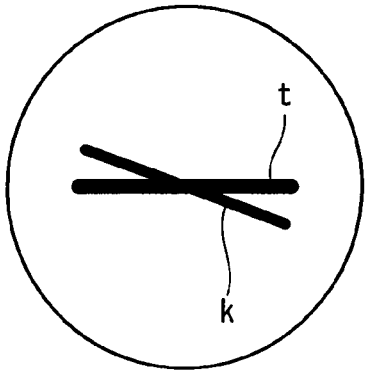
FIG. 5A, FIG. 5B, FIG. 5C, FIG. 5D, FIG. 5E, FIG. 5F, FIG. 5G and FIG. 5H show a view illustrating a golf ball according to other embodiment of the present invention.
Figure 5B:
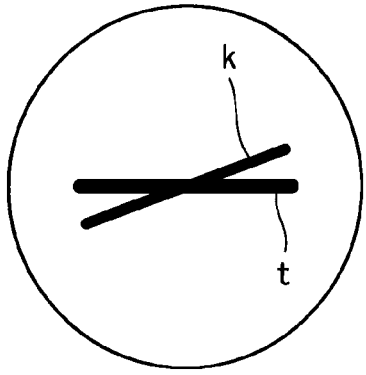
Figure 5C:
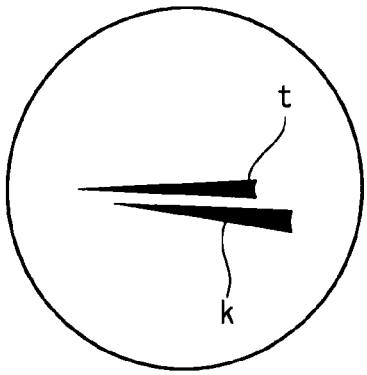
Figure 5D:
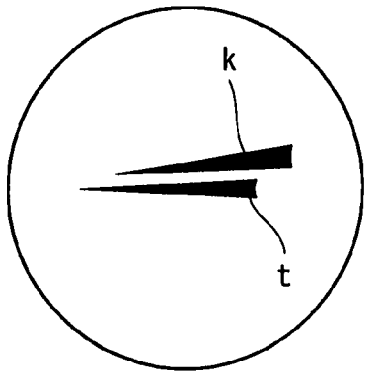
Figure 5E:
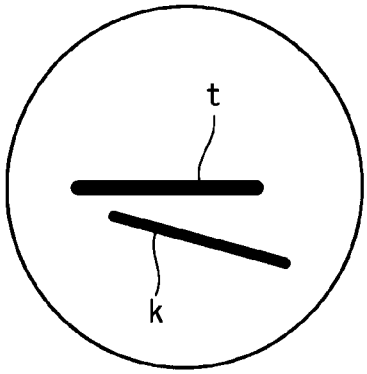
Figure 5F:
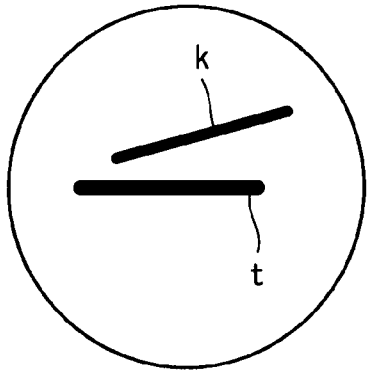
Figure 5G:
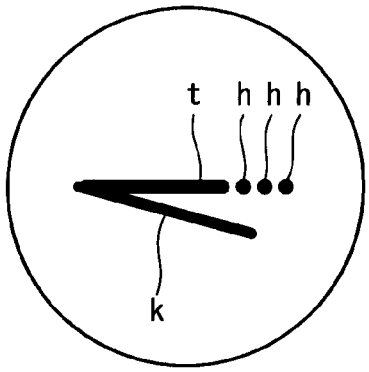
Figure 5H:
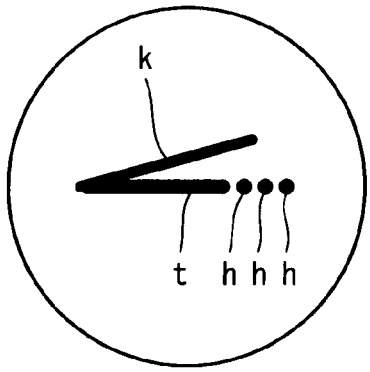

FIG. 4A shows a view illustrating a golf ball 6 according to other embodiment. In the group 8 of marks of the golf ball 6, the inclined marks k are not provided on both sides of the target mark t. In the group 8 of marks, the inclined mark k is provided on only one side of the target mark t.

Other embodiments in which the inclined mark k is placed on only either one of the left or right side of the target mark t are shown in FIG. 5C to FIG. 5H. Accordingly, the inclined mark k may be provided on both sides of the target mark t, or may be placed on only one of these sides of the target mark t.

Figure 6A:
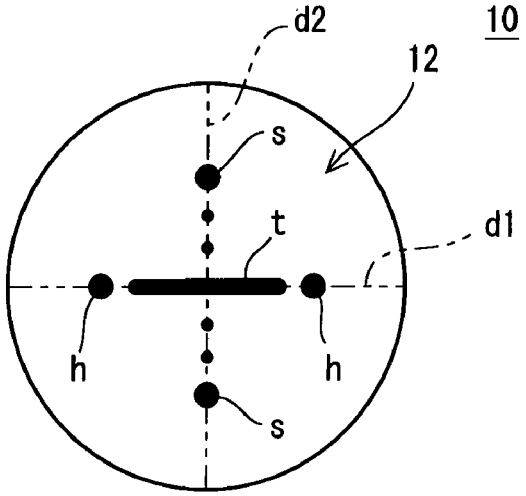
FIG. 6A shows a view illustrating a golf ball according to other embodiment of the present invention.

FIG. 6A shows a view illustrating a golf ball 10 according to other embodiment of the present invention. The golf ball 10 has a group 12 of marks. The group 12 of marks includes the target mark t, the accompanied marks h, and the side marks s. The group 12 of marks includes one target mark t, two accompanied marks h, and six side marks s.

According to the golf ball 2 shown in FIG. 1A described above, the accompanied marks h are provided only on one side of the target mark t. To the contrary, in the group 12 of marks, the accompanied marks h are provided on one side and another side of the target mark t. The accompanied marks h have a dot shape. The accompanied mark h has a circular shape.

The side mark s is a mark provided on the side of the target mark t. The side mark s and the target mark t are separated each other. The side marks s have a dot shape. The side mark s has a circular shape. By thus making the side marks s to have the dot shape, effect achieved by the side mark s described later is improved.

As shown in FIG. 6A, the side marks s are placed symmetrically with respect to the target mark t.

The target mark t is provided along a first great circle d1. The target mark t is positioned on this first great circle d1. Two accompanied marks h are both positioned on the first great circle d1. On the other hand, six side marks s are all positioned on a second great circle d2. The six side marks s appear to be aligned on one straight line.

The plane including the first great circle d1 (not shown in the figure), and the plane including the second great circle d2 (not shown in the figure) are orthogonal to one another. On the plan view, all side marks s are positioned on the perpendicular bisector of the target mark t.

The plan view means a projection image obtained by projecting the mark on a plane H that is perpendicular to a line L, provided that the line L is defined as a line drawn by connecting the center of the ball and the center of gravity of the target mark t. In this plan view, the image is projected in the direction perpendicular to the plane H.

In the present invention, it is desired that all marks are visible at one view upon the address. In this respect, it is preferred that the group of marks according to the present invention is disposed within a circle having a diameter of equal to or less than 30 mm in the aforementioned plan view.

Other embodiments involving the target mark t and the side mark s are shown in FIG. 7A to FIG. 7E and FIG. 8A to FIG. 8F. In all embodiments shown in FIG. 7A to FIG. 7E and FIG. 8A to FIG. 8F, the side marks s are provided symmetrically with respect to the target mark t.

The shape of the side mark s is not particularly limited. The embodiment shown in FIG. 7A includes rectangular side marks s having a dot shape. The embodiment shown in FIG. 7D includes regular tetragonal side marks s having a dot shape. The embodiment shown in FIG. 7E involves L-shaped side marks s having a dot shape, and arrowhead-like side marks s having a dot shape.

Figure 9A:
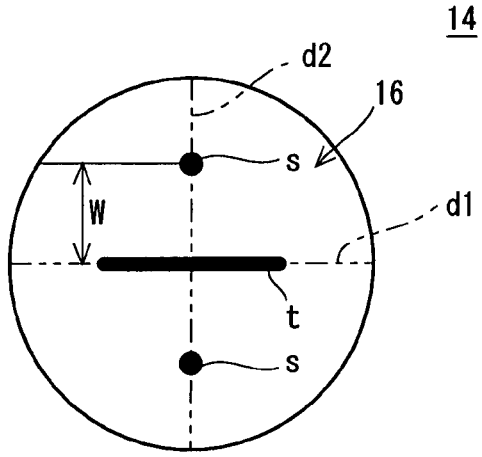
FIG. 9A shows a view illustrating a golf ball according to other embodiment of the present invention.
Figure 9B:
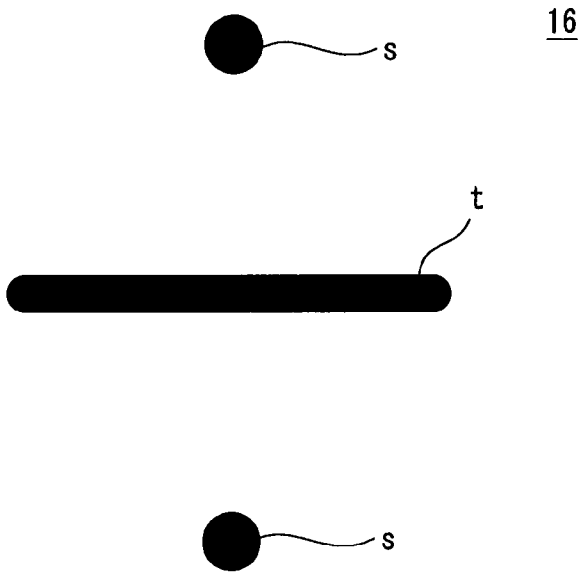
FIG. 9B shows an enlarged view illustrating a mark area in the golf ball shown in FIG. 9A.

FIG. 9A shows a view illustrating a golf ball 14 according to other embodiment. The group 16 of marks of the golf ball 14 includes the target mark t, and the side marks s. FIG. 9B shows an enlarged view of the group 16 of marks. This group 16 of marks includes one target mark t, and two side marks s. The group 16 of marks does not include the accompanied mark h. The side marks s are provided symmetrically with respect to the target mark t. The target mark t is provided on a first great circle d1, and the side marks s are provided on a second great circle d2. The plane including the first great circle d1, and the plane including the second great circle d2 are orthogonal to one another.

Figure 9C:
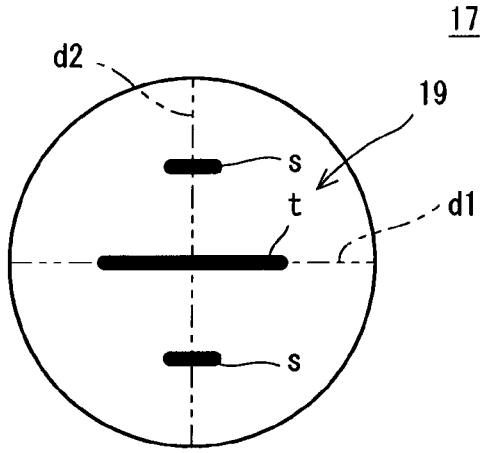
FIG. 9C shows a view illustrating a modified example of the golf ball shown in FIG. 9A.

FIG. 9C shows a view illustrating a golf ball 17 according to other embodiment. The group 19 of marks of the golf ball 17 includes the target mark t, and the side marks s. This group 19 of marks includes one target mark t, and two side marks s. The group 19 of marks does not include the accompanied mark h. The side marks s are provided symmetrically with respect to the target mark t. The target mark t is provided on a first great circle d1, and the side marks s are provided on a second great circle d2. The group 16 of marks according to the embodiment shown in FIG. 9A as described above includes side marks s having a dot shape. In contrast, the group 19 of marks according to FIG. 9C has a linear shape. The length of the linear side mark s in the longitudinal direction is smaller than that of the target mark t.

Figure 10A:
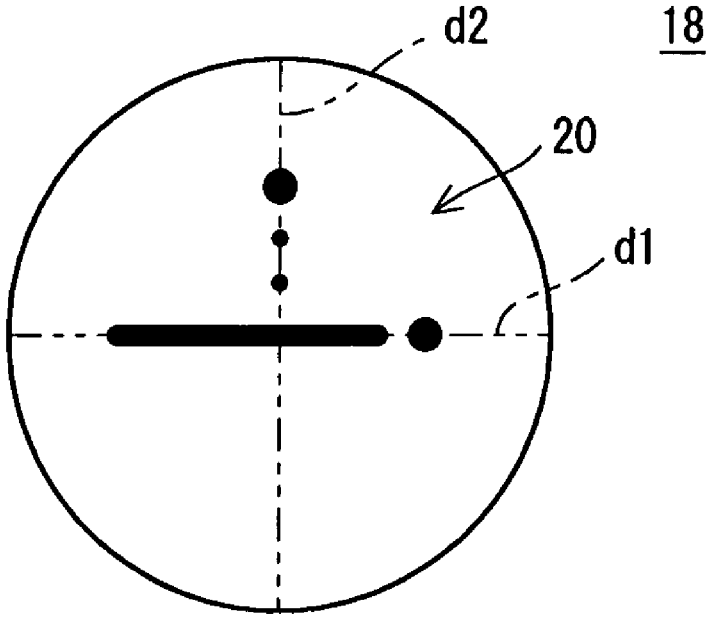
FIG. 10A shows a view illustrating a golf ball according to other embodiment of the present invention.
Figure 10B:
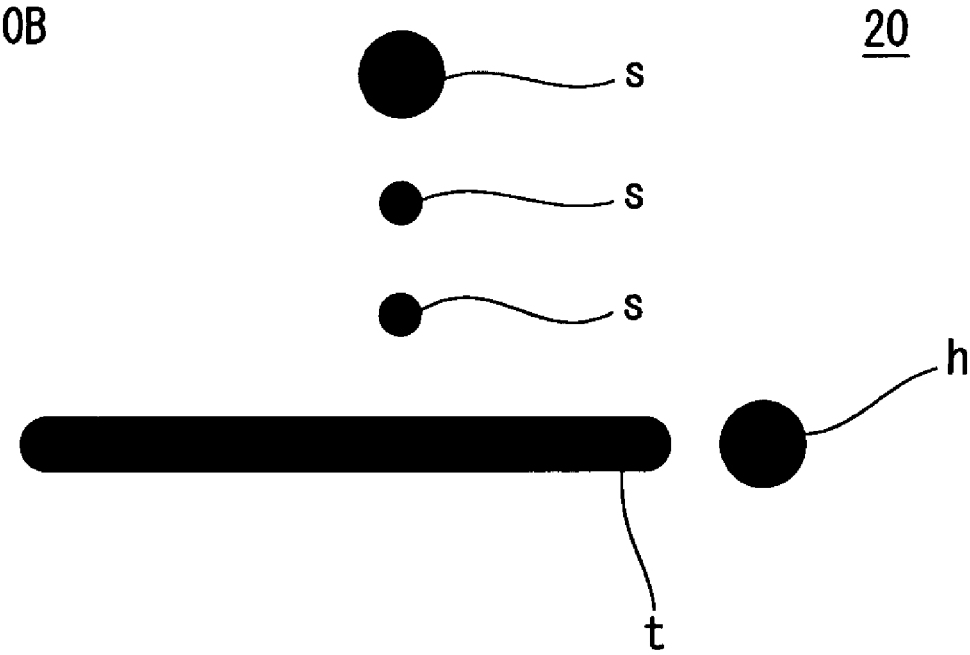
FIG. 10B shows an enlarged view illustrating a mark area in the golf ball shown in FIG. 10A.

FIG. 10A and FIG. 10B show a view illustrating a golf ball 18 according to other embodiment. The group 20 of marks of the golf ball 18 includes the target mark t, the accompanied mark h, and the side marks s. One target mark t, one accompanied mark h, and three side marks s are included. The accompanied mark h is provided on only one side of the target mark t. The side mark s is provided on only one of either right or left side of the target mark t.

Figure 11:
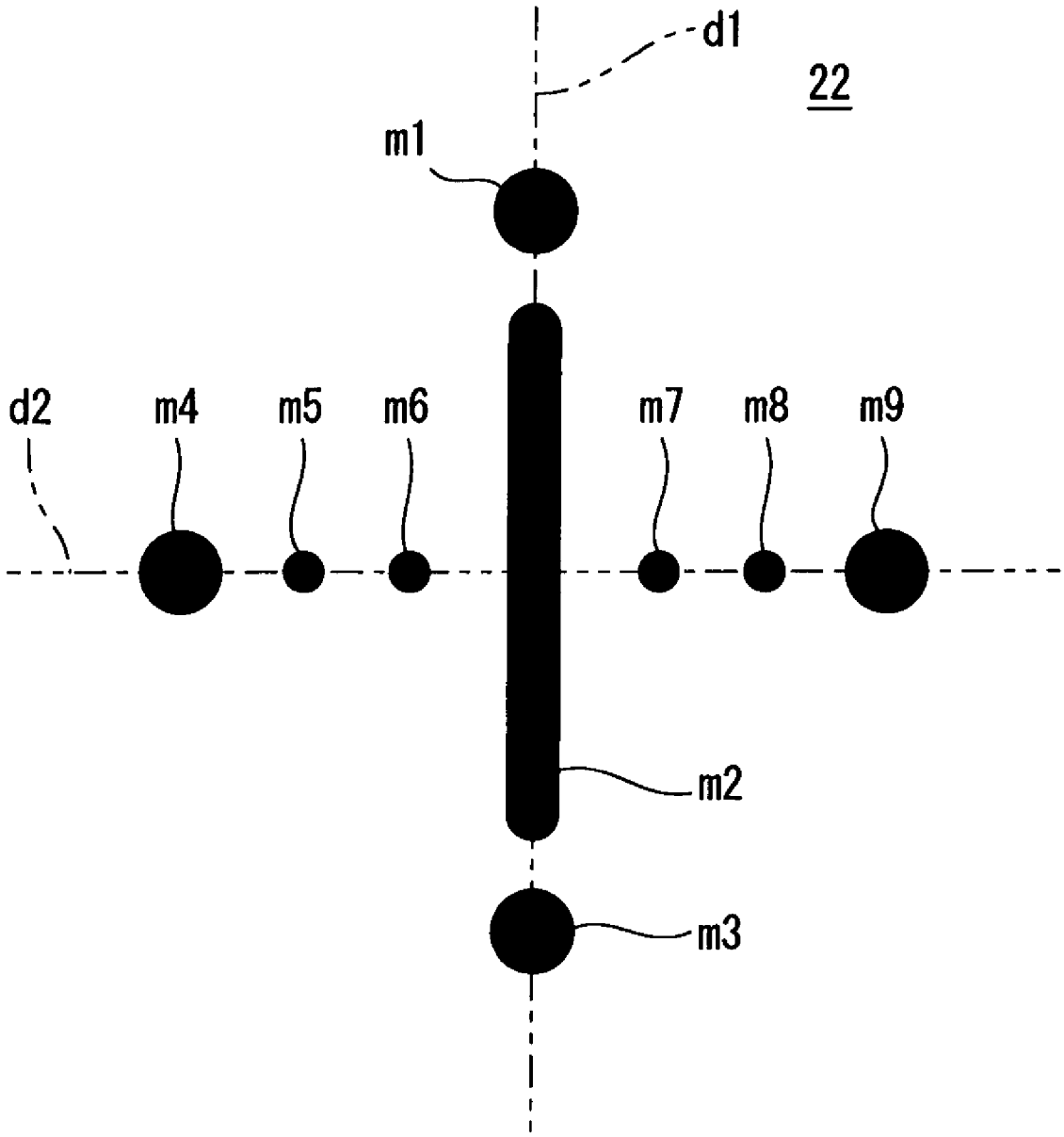
FIG. 11 shows a view for demonstrating definition of the marks according to the present invention.

FIG. 11 shows a view for illustrating definition of the marks according to the present invention. Group of marks 22 shown in FIG. 11 is the same as the group 12 of marks shown in FIG. 6A and FIG. 6B. However, the group 22 of marks shown in FIG. 11 is depicted following 90-degrees rotation of the group 12 of marks shown in FIG. 6A.

The group 22 of marks includes nine marks (hereinafter, may be also referred to as separate marks) in total. For convenience of explanation, each separate mark is designated as: separate mark m1; separate mark m2; separate mark m3; separate mark m4; separate mark m5; separate mark m6; separate mark m7; separate mark m8; and separate mark m9, respectively, as shown in FIG. 11.

Figure 6B:
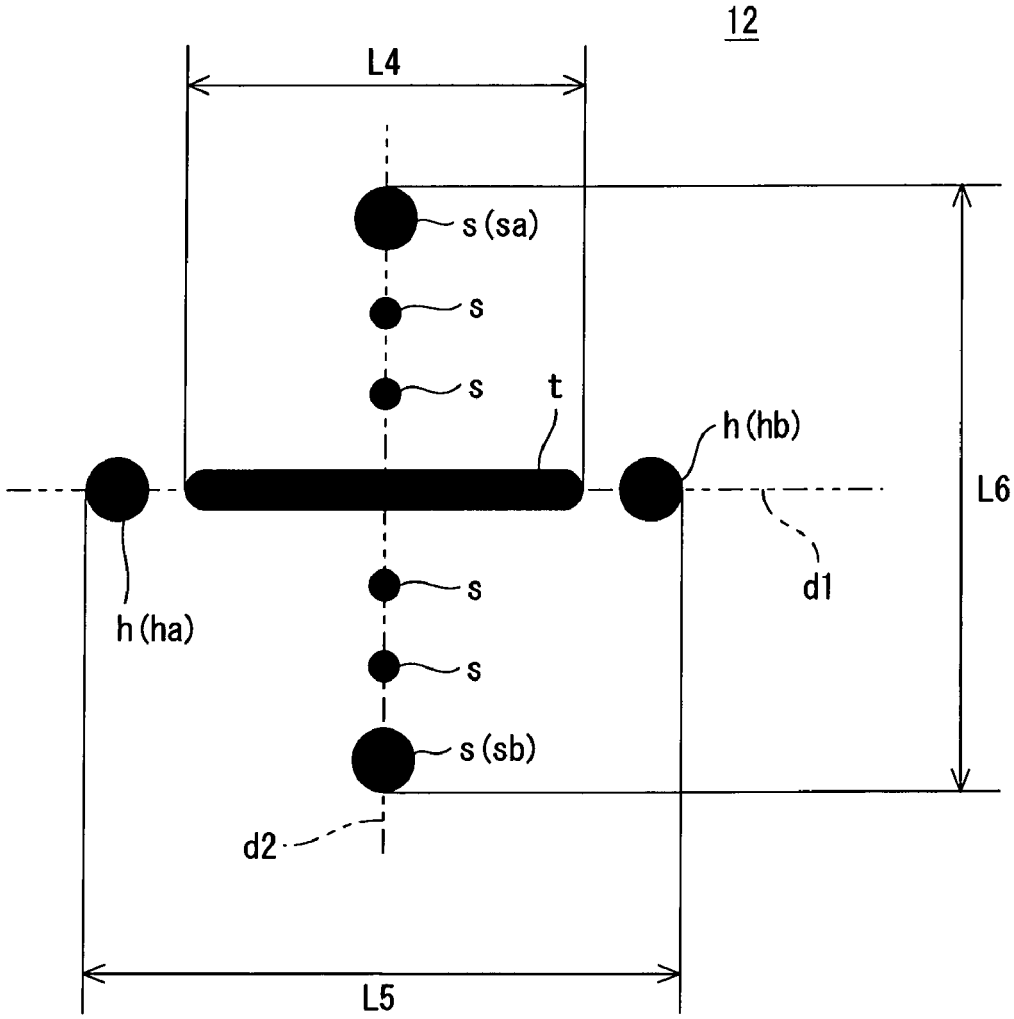
FIG. 6B. shows an enlarged view illustrating a mark area in the golf ball shown in FIG. 6A.
Figure 7A:
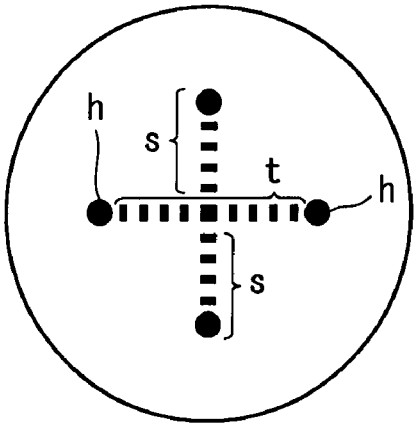
FIG. 7A, FIG. 7B, FIG. 7C, FIG. 7D and FIG. 7E show a view illustrating a golf ball according to other embodiment of the present invention.
Figure 7B:
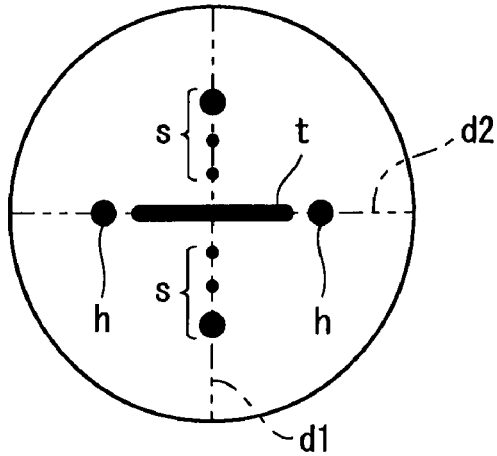
Figure 7C:
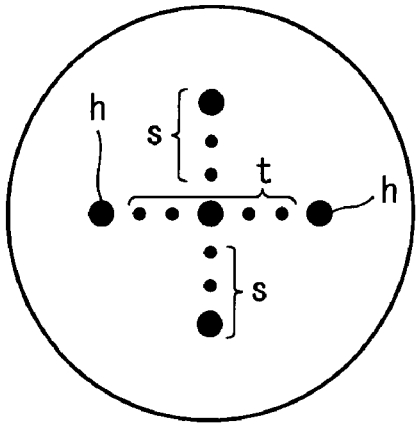
Figure 7D:
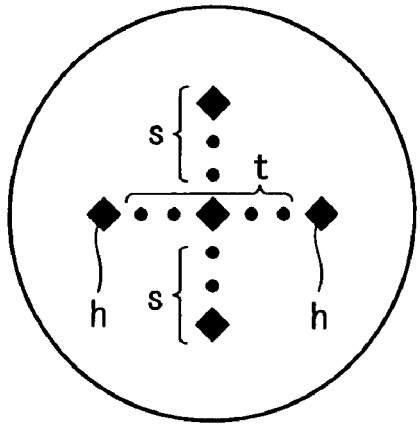
Figure 7E:
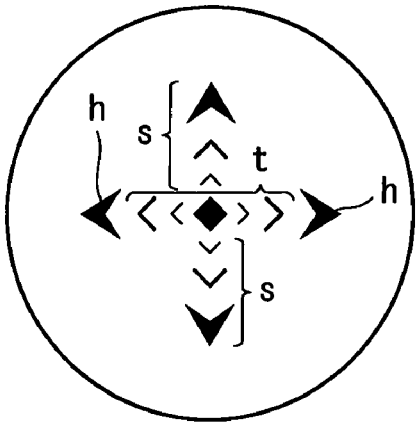

As is seen from the comparison of FIG. 6B with FIG. 11, the separate mark m2 is established as the target mark t in the group 12 of marks shown in FIG. 6B. However, as is understood from the definition of the target mark t in the present invention, the target mark t may also be an aggregate of dot marks. The target mark t may be, for example, an aggregate S1 of the separate mark m4, the separate mark m5, the separate mark m7 and the separate mark m8. The target mark t may also be an aggregate S2 including the separate mark m4 in addition to the aggregate S1. The target mark t may also be an aggregate S3 including the separate mark m9 in addition to the aggregate S2. The golf player can select preferred mark as the target mark t. The golf player may address after placing the ball such that the target line imaged from this target mark t directs toward the intended direction.

For example, in the case in which the aggregate S1 is regarded as a target mark t, the separate mark m4 and the separate mark m9 can be regarded as the accompanied mark h. This will be clearly comprehended from the definition of the accompanied mark h. Also, when the aggregate S1 is regarded as the target mark t, at least one of the separate mark m1, the separate mark m2 and the separate mark m3 can be regarded as the side mark s.

When the target mark t is an aggregate of dot marks, number of the dot marks that constitute the target mark t should be two or more. By such alignment of at least two dot marks along a great circle d, the target line can be imaged. Further, the inclined mark k may also be an aggregate of dot marks.

Figure 8A:
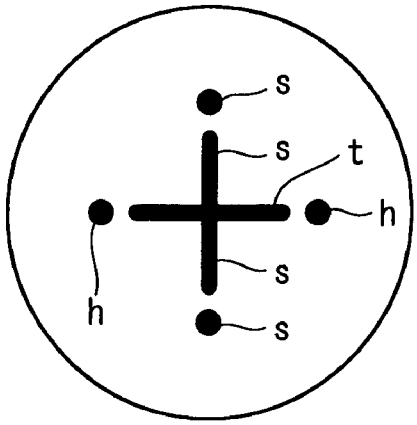
FIG. 8A, FIG. 8B, FIG. 8C, FIG. 8D, FIG. 8E and FIG. 8F show a view illustrating a golf ball according to other embodiment of the present invention.
Figure 8B:
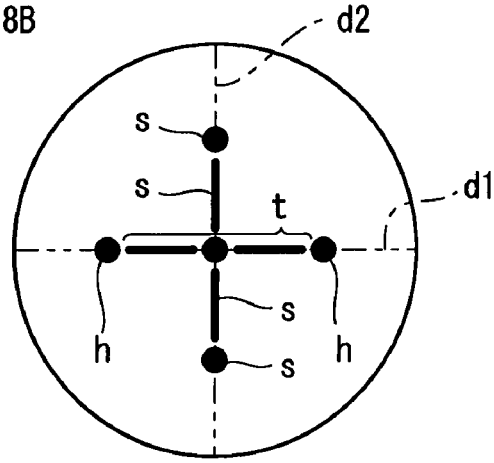
Figure 8C:
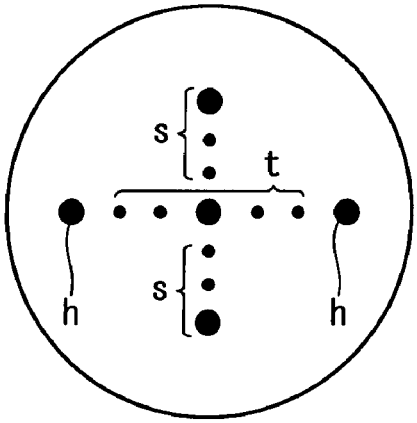
Figure 8D:
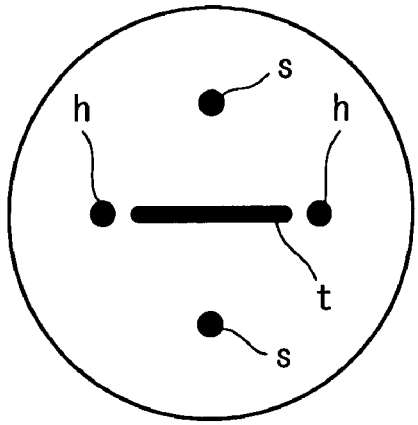
Figure 8E:
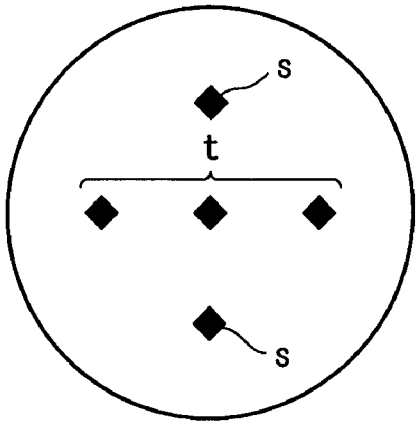
Figure 8F:
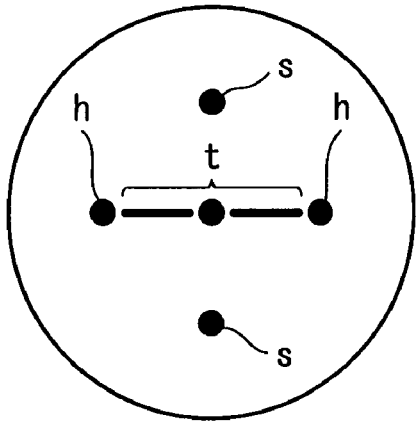
Figure 12:
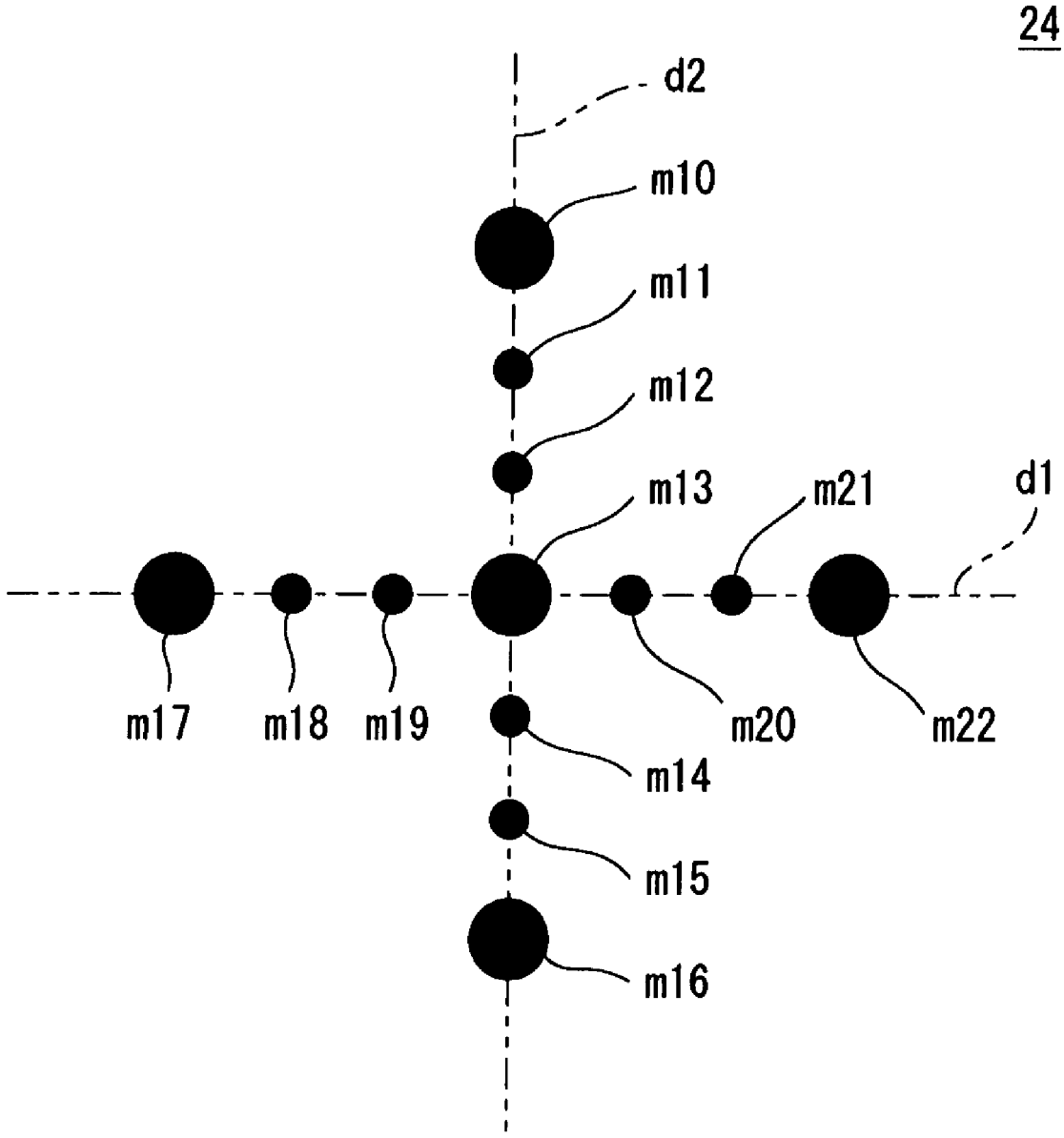
FIG. 12 shows a view for demonstrating definition of the marks according to the present invention.

FIG. 12 shows an enlarged view of the group 24 of marks according to FIG. 8C. Each of thirteen marks constituting this group 24 of marks is designated as a separate mark m10, a separate mark m11, a separate mark m12, a separate mark m13, a separate mark m14, a separate mark m15, a separate mark m16, a separate mark m17, a separate mark m18, a separate mark m19, a separate mark m20, a separate mark m21 and a separate mark m22, as shown in FIG. 12. In FIG. 8C, the separate mark m18, the separate mark m19, the separate mark m13, the separate mark m20 and the separate mark m21 are established as the target mark t; the separate mark m10, the separate mark m11 and the separate mark m12 are established as a first side mark s; the separate mark m14, the separate mark m15 and the separate mark m16 are established as a second side mark s; the separate mark m17 is established as a first accompanied mark h; and the separate mark m22 is established as a second accompanied mark h. However, for example, it is also possible to establish the separate mark m19, the separate mark m13 and the separate mark m20 as the target mark t, and establish the separate mark m17, the separate mark m18, the separate mark m21 and the separate mark m22 as the accompanied mark h.

In the group 24 of marks, the marks on the first great circle d1 are equivalent to the marks on the second great circle d2. Therefore, at least two of from the separate mark m10 to the separate mark m16 aligned along the second great circle d2 may be established as the target mark t. In the case in which the marks aligned along the second great circle d2 are established as the target mark t, the marks aligned along the first great circle d1 can be established as the side mark s.

Figure 13:
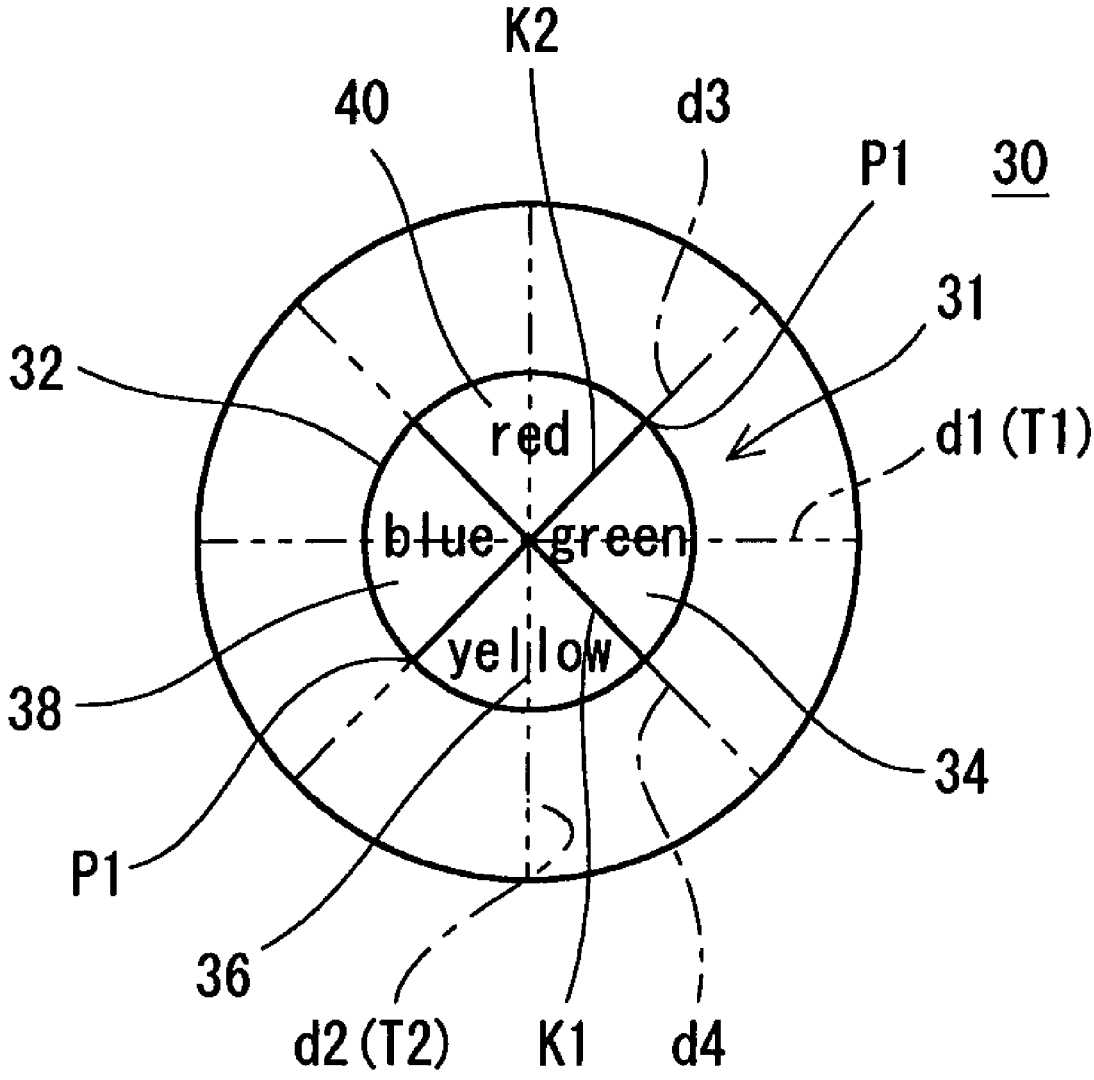
FIG. 13 shows a view illustrating a golf ball according to other embodiment of the present invention.

FIG. 13 shows a view illustrating a golf ball 30 according to other embodiment. The golf ball 30 has a group 31 of marks. This group 31 of marks has multiple colors. Contour 32 of the external margin of the group 31 of marks is circular in a plan view. The group 31 of marks is constituted with a first region 34, a second region 36, a third region 38, and a fourth region 40. In FIG. 13, one including the first region 34 being green, the second region 36 being yellow, the third region 38 being blue, and the fourth region 40 being red is illustrated. The color of each region is not limited thereto. The color of each region is different from the color of the adjacent region. On the contour 32 may also be depicted a contour line. The contour line may not be depicted on the contour 32 but rather a boundary between different colors shows the contour. Two colors may be employed, and the marks may be arranged such that the two colors appear alternately.

On the plan view, the group 31 of marks forms a circular mark in which regions having a color that is different from the adjacent region are arranged every predetermined angle around the center. This predetermined angle is 90 degrees in the group 31 of marks. However, this predetermined angle is not limited. Illustrative examples of this predetermined angle include 10 degrees, 15 degrees, 30 degrees, 45 degrees, 60 degrees, 180 degrees and the like. In general, when this predetermined angle is N degrees, (360/N) regions are provided on the plan view. Although the details will be described later, the boundary of these (360/N) regions can be the target mark t. Additionally, the regions provided on the side of this target mark t can be side marks s.

The boundary between the first region 34 and the second region 36 is positioned on a fourth great circle d4. The boundary between the second region 36 and the third region 38 is positioned on a third great circle d3. The boundary between the third region 38 and the fourth region 40 is positioned on a fourth great circle d4. The plane including the third great circle d3, and the plane including the fourth great circle d4 are orthogonal to one another. The boundary between the fourth region 40 and the first region 34 is positioned on the third great circle d3. On the boundary that comparts each of these regions may or may not be present a boundary line. Also in the case in which the boundary line is not present, the boundary between different colors can be observed as if there exists a boundary line.

Provided that the intersection of the third great circle d3 and the fourth great circle d4 is defined as a pole, the contour 32 corresponds to the latitude line with respect to this pole. Provided that the intersection of a great circle that includes the first boundary (for example, third great circle d3) and the great circle that includes the second boundary (for example, fourth great circle d4) among the boundaries between the regions is defined as a pole, the contour 32 corresponds to the latitude line with respect to this pole.

In the group 31 of marks, the target mark t can be established. The target mark t is a line T1 that equally divides, for example, the first region 34 and the third region 38 into two portions on the plan view. In FIG. 13, this bisector T1 is positioned on the first great circle d1. The target mark t may be, for example, a line T2 that equally divides the second region 36 and the fourth region 40 on the plan view. In FIG. 13, this bisector T2 is positioned on the second great circle d2. The plane including the first great circle d1 is orthogonal to the plane including the second great circle d2.

For example, a boundary K1 that comparts adjacent regions can be the target mark t. This boundary K1 is positioned on the fourth great circle d4. A boundary K2 that comparts adjacent regions can also be the target mark t. This boundary K2 is positioned on the third great circle d3. On the plan view, the boundary K1 and the boundary K2 are lines indicating the diameter of the contour 32.

In the group 31 of marks, the side mark s can be established. For example, provided that the bisector T1 described above is established as the target mark t, the second region 36 and/or the fourth region 40 can have the side mark s. Preferably, the external margin (contour 32) of the second region 36, or the external margin (contour 32) of the fourth region 40 can correspond to the side mark s. For example, provided that the boundary K1 described above is established as the target mark t, an intersection P1 of the boundary K2 and the contour 32 can be established as the side mark s.

The golf ball 30 includes multiple regions having different colors. The boundary of this region has a straight section. This straight section may correspond to, for example, the boundary K1 and the boundary K2. The ball may be placed so that this straight section is allowed to direct toward the target, and then the player can swing while looking at the region positioned on the side of this straight section (side region). This side region can serve as the side mark s. Also, an inclined region constructed such that it appears to be inclined with respect to the straight section may be also provided. This inclined region can serve as the inclined mark k. Furthermore, an accompanied region may be also provided on the same great circle as the straight section described above. This accompanied region can serve as the accompanied mark h. Accordingly, the present invention may include region (area) in the form of the mark (group of marks) to serve as the eyemark, in place of the lines and dots.

The side mark s or the accompanied mark h may affect the orbit of the head, ballistic trajectory or impact point.

Typical method of use of the golf ball according to the present invention will be explained. The golf ball according to the present invention is effective in occasions in which golf players can place the ball with a setting of the direction optionally selected such as tee shots and puttings.

Upon tee shots, the ball is placed such that the target mark t faces on the upper side, and the target line is directed toward the intended direction. The golf player addresses based on this target line. For example, the addressing may be executed so that the face surface orientation agrees with the direction of the target line. The target line is, as described above, a line imaged by the target mark. The target line agrees, on the plan view, with the great circle d that runs along the target mark t.

Next, a shot is made while looking at the inclined mark k, the side mark s or the accompanied mark h. Accordingly, the following "Effect due to Inclined Mark k", "Effect due to Side Marks" or "Effect due to Accompanied Mark h" can be achieved.

[Effect Due to Inclined Mark k]

When a swing is made such that the head moves along any inclined mark k, the orbit of the head will be outside-in or inside-out. For example, a case is envisaged in which a right-handed golf player addresses and hits the golf ball 2 in the state of permitting the group 4 of marks to be visible as shown in FIG. 1A. In this case, the target is present on the left-hand side of FIG. 1A, and the ball is hit to be oriented to the left-hand direction of FIG. 1A. Upon the hitting, outside-in ballistic trajectory is apt to be achieved when the swing is made so as to move the head along the first inclined mark ka among two inclined marks k. The outside-in ballistic trajectory is likely to result in a slice or fade ball flight. Inside-out ballistic trajectory is apt to be achieved when the swing is made so as to move the head along the second inclined mark kb. The inside-out ballistic trajectory is likely to result in a hook or draw ball flight.

Hence, the orbit of the head can be controlled by the inclined mark k. Desired ballistic trajectory can be achieved by the inclined mark k. For the golf players who are troubled over excess slice or hook, the inclined mark k can be of assistance in correction of the excess slice or hook.

What is indicated by a symbol θ in FIG. 1B is an angle formed between the great circle d along the target mark t, and the mid line k1 in the cross direction of the inclined mark k. In light of the improvement of the effect to control the orbit of the head, the angle θ is preferably equal to or greater than 1 degree, more preferably equal to or greater than 2 degrees, and particularly preferably equal to or greater than 3 degrees. In light of prevention of achieving excess outside-in or inside-out ballistic trajectory, and improvement of control performance of the ballistic trajectory, the angle θ is preferably equal to or less than 30 degrees, more preferably equal to or less than 20 degrees, and particularly preferably equal to or less than 10 degrees. This angle θ can be an angle on the aforementioned plan view.

[Effect Due to Side Mark s]

For example, a case is envisaged in which a right-handed golf player addresses and hits the golf ball 10 in the state of permitting the group 12 of marks to be visible as shown in FIG. 6A. In this case, the target is present on the left-hand side of FIG. 6A, and the ball is hit to be oriented to the left-hand direction of FIG. 6A. Upon the hitting, the impact point is apt to be on the heel side of the head as compared with common swing, when the swing is made while looking at the side mark sa positioned on the side far away than the target mark t from the golf player (see, FIG. 6B) because the golf player can swing easily with the side mark sa regarding as a center of the ball by swinging while looking at the side mark sa. Hence, when the swing is made while looking at the side mark sb positioned on the side closer than the target mark t to the golf player (see, FIG. 6B), the impact point is apt to be on the toe side of the head as compared with common swing.

In this manner, the impact point can be controlled by the side mark s. By thus controlling the impact point, the ballistic trajectory can be controlled. By thus attaining the impact point closer to the heel, a slice ball flight is liable to be attained with a wood club. By attaining the impact point closer to the heel, a hook ball flight is liable to be attained with an iron club. By attaining the impact point closer to the toe, a hook ball flight is liable to be attained with a wood club. By attaining the impact point closer to the toe, a slice ball flight is liable to be attained with an iron club.

The side mark s can be responsible for correction of the impact point. Golf players who attain the impact point extremely close to the heel, and those who attain the impact point extremely close to the toe can attain the impact point closer to the center owing to the side mark s.

What is indicated by a symbol W in FIG. 9A is a distance between centers of the target mark t and the side mark s. In light of the improvement of the effect to allow the impact point to shift, the distance W is preferably equal to or greater than 1 mm, more preferably equal to or greater than 2 mm, and in particular preferably equal to or greater than 3 mm. When the impact point excessively shifts, hook or slice may be excessive, and the impact point may be too far away from the sweet spot. In this respect, the distance W is preferably equal to or less than 10 mm, more preferably equal to or less than 9 mm, and particularly preferably equal to or less than 8 mm. The distance W can be the distance on the above plan view.

[Effect Due to Accompanied Mark h]

For example, a case is envisaged in which a right-handed golf player addresses and hits the golf ball 10 in the state of permitting the group 12 of marks to be visible as shown in FIG. 6A. In this case, the target is present on the left-hand side of FIG. 6A, and the ball is hit to be oriented to the left-hand direction of FIG. 6A. Upon the hitting, the orbit of the head is apt to be down blow as compared with common swing, when the swing is made while looking at the accompanied mark ha positioned ahead toward the intended direction than the target mark t (see, FIG. 6B) because the golf player can swing easily with the accompanied mark ha regarding as a center of the ball by swinging while looking at the accompanied mark ha. When the swing is made while looking at the accompanied mark hb positioned backward of the intended direction than the target mark t (see, FIG. 6B), the orbit of the head is apt to be upper blow as compared with common swing.

In this manner, the blow angle of the head can be controlled by accompanied mark h. The orbit of the head that is more approximate to down blow may decrease the launch angle, while the back spin rate may be increased. The orbit of the head that is more approximate to upper blow may increase the launch angle, while the back spin rate may be decreased. The ballistic trajectory can be thus controlled owing to the accompanied mark h.

The accompanied mark h can also assist the correction of duffing (fat shot) or topping (topped shot). Duffing is likely to be suppressed as compared with common swing, when the swing is made while looking at the accompanied mark ha positioned ahead toward the intended direction than the target mark t because the golf player can swing easily with the accompanied mark ha regarding as a center of the ball by swinging while looking at the accompanied mark ha. When the swing is made while looking at the accompanied mark hb positioned backward of the intended direction than the target mark t, the topping is apt to be suppressed as compared with common swing. For reference, the duffing refers to miss shots caused by hitting of the ground by the head at a position short of the ball. The topping refers to miss shots caused by hitting of the ball at the top by the head.

For example, the group 20 of marks shown in FIG. 10A and FIG. 10B can have a similar function to that of the group 12 of marks shown in FIG. 6A. Although the group 20 of marks shown in FIG. 10A and FIG. 10B includes the accompanied mark h on one side of the target mark t, there is no accompanied mark h on another side of the target mark t. However, when the group 20 of marks is rotated 180 degrees, the accompanied mark h provided on the one side of the target mark t has come to be located on the another side of the target mark t. In other words, depending on how the ball is placed, the accompanied mark h of the group 20 of marks can be located either backward of the intended direction, or ahead toward the intended direction with respect to the target mark t.

Although the group 20 of marks shown in FIG. 10A includes the side mark s on the far side of the target mark t, there is no side mark s on the near side of the target mark t. However, when the group 20 of marks is rotated 180 degrees, the side mark s provided on the far side of the target mark t has come to be located on the near side of the target mark t. In other words, depending on how the ball is placed, the side mark s of the group 20 of marks can be located either on the near side with respect to the target mark t, or on the far side with respect to the target mark t. Furthermore, by placing the ball through rotating 90 degrees, the side mark s can be the accompanied mark h, while the accompanied mark h can be the side mark s. Accordingly, the golf ball according to the present invention can achieve various actions and effects depending on how it is placed.

EXAMPLES

Hereinafter, advantages of the present invention will be explained by way of Examples, however, the present invention should not be construed as being limited based on the description of the Examples. For reference, the size such as distance and the angle described below were measured on the plan view set out in the foregoings.

Example 1

A golf ball of Example 1 was obtained by printing the group 4 of marks shown in FIG. 1A on a commercially available golf ball. The color of the group of marks was black. The length L1 of the target mark t was 18 mm; the length L2 of the inclined mark k was 17 mm; the distance L3 from the front end of the target mark t to the rear end of the accompanied mark h which is positioned the farthest from the target mark t was 26 mm; and the angle θ was 7.5 degrees (see, FIG. 1B). The accompanied mark h had a diameter of 1.7 mm, and the target mark t had a thickness of 2.0 mm.

Example 2

A golf ball of Example 2 was obtained similarly to Example 1 except that the group 4 of marks was changed to the group 12 of marks shown in FIG. 6A. The color of the group of marks was black. The length L4 of the target mark t was 17 mm; the distance L5 from the front end of the accompanied mark ha to the rear end of the accompanied mark hb was 23.2 mm; the distance L6 from the end of the side mark sa to the end of the side mark sb was 21.8 mm; the accompanied mark h had a diameter of 2.7 mm; the side mark sa and the side mark sb had a diameter of 2.7 mm, while other side marks s had a diameter of 1.35 mm; and the target mark t had a thickness of 2.0 mm (see, FIG. 6B).

[Evaluation]

Evaluation was made by two testers, Mr. A, and Mr. B. Mr. A and Mr. B were characterized as in the followings. Both Mr. A and Mr. B were right-handed.

[Mr. A]
Dominate ball; fade
head speed (in use of driver): 37 m/s

[Mr. B]
Dominate ball; draw
head speed (in use of driver): 43 m/s

Evaluation Method

Example 1

The golf ball of Example 1 was evaluated as follows. First, the ball was placed so that the target mark t faced the upper side, while the target line was directed toward the intended direction. Next, each tester addressed based on this target line. Each tester addressed so that the face surface orientation agreed with the direction of the target line. Each tester addressed in the state of permitting the group 4 of marks to be visible as shown in FIG. 1A. Thus addressed golf player hit the golf ball 2 shown in FIG. 1A. The target was present on the left-hand side of FIG. 1A, and the ball was hit to be oriented to the left-hand direction of FIG. 1A. Each tester swung the club while looking at any mark among the group 4 of marks. The results of this evaluation are shown in Table 1 below. The test was carried out using a driver (W#1). The results of evaluation using the driver are shown in Table 1 below.

Evaluation Method

Example 2

The golf ball of Example 2 was evaluated as follows. First, the ball was placed so that the target mark t faced the upper side, while the target line was directed toward the intended direction. Next, each tester addressed based on this target line. Each tester addressed so that the face surface orientation agreed with the direction of the target line. Each tester addressed in the state of permitting the group 12 of marks to be visible as shown in FIG. 6A. Thus addressed each tester hit the golf ball 10 shown in FIG. 6A. The target was present on the left-hand side of FIG. 6A, and the ball was hit to be oriented to the left-hand direction of FIG. 6A. Each tester swung the club while looking at any mark among the group 12 of marks. The results of this evaluation are shown in Table 2 below. The test was carried out using a driver (W#1). The results of evaluation using the driver are shown in Table 2 below.

[Driver Used in Evaluation]

Mr. A used ALL NEW XXIO (loft: 11 degrees, shaft item number: MP400, shaft flex: R) as a driver. Mr. B used ALL NEW XXIO (loft: 9 degrees, shaft item number: MP400, shaft flex: S) as a driver.

[Swing Orbit]

"Swing Orbit" means the angle in the right-left direction of the orbit of the head immediately before the impact with respect to the intended direction. The swing orbit indicates the degree of outside-in, or inside-out. A camera was set just above the point P where the ball was placed in the addressing. When the club head passed two positions, i.e., 3 cm and 9 cm to the impact point respectively, the photoflash was lighted to take pictures by the camera from above. By thus taking pictures, image data were obtained having two head images at the moment of lighting of the flash. An angle α (degree) formed by the intended direction and a line drawn between the two images was analyzed based on the image data. This angle α (degree) is shown in Tables below in the column of "Swing orbit". The angle α is an angle in the horizontal direction. The angle α is represented by a plus (+) value in the case of inside-outballistic trajectory, while it is represented by a negative (−) value in the case of outside-inballistic trajectory.

[Deflection Angle]

"Deflection Angle" means the angle in the right-left direction of the ball speed (vector) immediately after launch with respect to the intended direction. The ball was placed at the point P, and a laser sensor was disposed at a point A 300 mm away at a horizontal distance from the point P. This laser sensor involves multiple laser beams extending in the vertical direction. This laser sensor can sense the location where the ball passes. These laser beams form multiple lines running in parallel in the right-left direction. The laser beams are blocked when the hit ball passes. Based on the positions of the laser beams thus blocked, the location A1 where the ball passed on the point A was determined. The location A1 is a position in the right-left direction. An angle β (degree) formed by the target line and a line drawn between the location A1 and the point P is shown in Tables below in the column of "Deflection angle". The angle β is an angle in the horizontal direction. The angle β was defined as plus (+) in the case of right hand pointing than the target line, while it was defined as negative (−) in the case of left hand pointing than the target line.

[Launch Angle]

"Launch Angle" means the orientation in the vertical direction of the ball speed (vector) immediately after the launch. A laser sensor was disposed at a point B 500 mm away at a horizontal distance from the point P where the ball was placed upon the address. This laser sensor involves multiple laser beams extending in the horizontal direction. These laser beams form multiple lines running in parallel in the vertical direction. This laser sensor can sense the location where the ball passes. The laser beams are blocked when the hit ball passes. Based on the positions of the laser beams thus blocked, the location B1 where the ball passed on the point B was determined. The location B1 is a position in the vertical direction. An angle γ (degree) formed by the horizontal line and a line drawn between the location B1 and the point P is shown in Table below in the column of "Launch angle". The angle γ is an angle in the vertical direction.

[Side Spin]

Ball image G1 after 3000 μsec following the impact, and the ball image G2 after 8000 μsec following the impact were taken. By analyzing movement of a mark for measuring the spin which had been depicted on the ball beforehand in two image G1 and image G2, side spin rate (rpm) of the ball immediately after the impact was determined. This side spin rate is shown in Tables below in the column of "Side spin". The side spin is represented by a plus (+) value in the case of a slice spin, while it is represented by a negative (−) value in the case of a hook spin.

TABLE 1

Evaluation results of Example 1 (driver)

| Tester | Mark used in swing as an eyemark | Swing orbit (degree) | Deflection angle (degree) | Side spin (rpm) |
|---|---|---|---|---|
| Mr. A | first inclined mark ka | 2.2 | 1.9 | 800 |
| | target mark t | 3.9 | 3.8 | 550 |
| | second inclined mark kb | 6.4 | 5.5 | −200 |
| Mr. B | first inclined mark ka | 1.9 | −4 | −150 |
| | target mark t | 2.5 | −1.9 | −500 |
| | second inclined mark kb | 2.9 | 1.5 | −750 |

TABLE 2

Table 2: Evaluation results of Example 2 (driver)

| Tester | Mark used in swing as an eyemark | Swing orbit (degree) | Deflection angle (degree) | Launch angle (degree) | Side spin (rpm) |
|---|---|---|---|---|---|
| Mr. A | target mark t | 3.7 | 3.8 | 14.4 | 550 |
| | side mark sa | 4.0 | 3.8 | 14.6 | 450 |
| | side mark sb | 6.0 | 3.5 | 14.8 | 200 |
| | accompanied mark ha | 3.8 | 3.5 | 12.5 | 600 |
| | accompanied mark hb | 3.5 | 3.8 | 16.3 | 400 |
| Mr. B | target mark t | 2.5 | −4.0 | 11.9 | −500 |
| | side mark sa | 2.0 | −4.5 | 9.9 | −400 |
| | side mark sb | 6.0 | −1.6 | 11.6 | −500 |
| | accompanied mark ha | 3.8 | −4.0 | 7.3 | −600 |
| | accompanied mark hb | 3.5 | −4.3 | 13.2 | −350 |

As is clear from the results in the above Tables, the balls hit while looking at the first inclined mark ka in Example 1 attained the ballistic trajectory more approximate to be outside-in as compared with the balls hit while looking at the target mark t. In addition, the balls while looking at the second inclined mark kb in Example 1 attained the ballistic trajectory more approximate to be inside-out as compared with the balls hit while looking at the target mark t.

As is clear from the results in the above Tables, the balls hit while looking at the side mark sa in Example 2 were apt to be hit at a position closer to the heel as compared with the balls hit while looking at the target mark t. When the ball is hit at a position closer to the heel, a slice ball flight is likely to be attained with a driver, whereby the side spin is apt to be increased because the driver greatly achieves a gear effect generally referred to. For reference, when the ball is hit at a position closer to the heel, a hook ball flight is likely to be attained with an iron club, whereby the side spin is apt to be decreased because the iron club is apt to place priority on the effect of closed face by head rotation resulting from the impact force of the hit ball than the gear effect.

As is clear from the results in the above Tables, the balls hit while looking at the side mark sb in Example 2 were apt to be hit at a position closer to the toe as compared with the balls hit while looking at the target mark t. When the ball is hit at a position closer to the toe, a hook ball flight is likely to be attained with a driver, whereby the side spin is apt to be decreased because the driver greatly achieves a gear effect generally referred to. For reference, when the ball is hit at a position closer to the toe, a slice ball flight is likely to be attained with an iron club, whereby the side spin is apt to be increased because the iron club is apt to place priority on the effect of open face by head rotation resulting from the impact force of the hit ball than the gear effect.

As is clear from the results in the above Tables, the balls hit while looking at the accompanied mark ha in Example 2 achieved a smaller launch angle as compared with the balls hit while looking at the target mark t because of the attained ballistic trajectory more approximate to the down blow. As is clear from the results in the above Tables, the balls hit while looking at the accompanied mark hb in Example 2 achieved a greater launch angle as compared with the balls hit while looking at the target mark t because of the attained ballistic trajectory more approximate to the upper blow.

Accordingly, advantages of the present invention are clearly suggested by the results of evaluation shown in Table 1 and Table 2.

The present invention can be applied to any and all golf balls.

The foregoing description is just for illustrative examples, therefore, various modifications can be made in the scope without departing from the principles of the present invention.

What is claimed is:

1. A golf ball having a group of multiple marks which are visible at one view, the group of marks including a target mark consisting of single or multiple marks provided along one great circle, an inclined mark which appears to be inclined with respect to the target mark, and an accompanying mark provided on the same great circle as the target mark, the accompanying mark being positioned on one end side of the target mark wherein the target mark is oriented along the target line of the golf ball to allow for orientation of the face of a golf club at address, wherein the inclined mark is a linear mark with an outer side edge which appears to be inclined with respect to the target mark, and wherein the inclined mark has a width increasing from one end toward another end.

* * * * *